US009835024B2

(12) United States Patent
Ramirez Sabag et al.

(10) Patent No.: US 9,835,024 B2
(45) Date of Patent: Dec. 5, 2017

(54) INTEGRAL ANALYSIS METHOD OF INTER-WELL TRACER TESTS

(71) Applicant: Instituto Mexicano del Petroleo, Mexico City (MX)

(72) Inventors: Jetzabeth Ramirez Sabag, Mexico City (MX); Oscar Cerapio Valdiviezo Mijangos, Mexico City (MX)

(73) Assignee: INSTITUTO MEXICANO DEL PETROLEO, Mexico City (MX)

( * ) Notice: Subject to any disclaimer, the term of this patent is extended or adjusted under 35 U.S.C. 154(b) by 597 days.

(21) Appl. No.: 13/852,394

(22) Filed: Mar. 28, 2013

(65) Prior Publication Data

US 2013/0277543 A1 Oct. 24, 2013

(30) Foreign Application Priority Data

Mar. 30, 2012 (MX) ..... MX/a/2012/003870

(51) Int. Cl.

| | |
|---|---|
| ***G01V 9/00*** | (2006.01) |
| ***E21B 47/10*** | (2012.01) |
| *G06F 11/30* | (2006.01) |

(52) U.S. Cl.
CPC ..... *E21B 47/1015* (2013.01)

(58) Field of Classification Search
CPC ..... E21B 47/1015
See application file for complete search history.

(56) References Cited

U.S. PATENT DOCUMENTS

| | | | | |
|---|---|---|---|---|
| 3,933,131 | A | 1/1976 | Smith | |
| 4,099,565 | A | 7/1978 | Sheely, Jr. et al. | |
| 4,273,187 | A | 6/1981 | Satter et al. | |
| 4,481,597 | A * | 11/1984 | Robbins | 708/5 |
| 4,482,806 | A | 11/1984 | Wagner, Jr. et al. | |
| 5,072,387 | A | 12/1991 | Griston et al. | |
| 5,168,927 | A | 12/1992 | Stegemeier et al. | |
| 5,305,209 | A | 4/1994 | Stein et al. | |
| 5,410,152 | A * | 4/1995 | Gadeken | 250/260 |
| 7,472,748 | B2 | 1/2009 | Gdanski et al. | |
| 2009/0211754 | A1 | 8/2009 | Verret et al. | |
| 2010/0006292 | A1 | 1/2010 | Boles et al. | |

OTHER PUBLICATIONS

Du, Y. et al., Interwell Tracer Tests: Lessons Learned from Past Field Studies, 2005, SPE 93140.

* cited by examiner

*Primary Examiner* — Phuong Huynh
(74) *Attorney, Agent, or Firm* — Dickinson Wright PLLC

(57) ABSTRACT

The present invention relates an Integral analysis method of inter-well tracer tests, which integrates and performs continuous feedback to each of the major stage (design, operation and interpretation) allowing quantitative interpretation of these tests. It is presented as a tool to investigate the behavior of injection fluids for recovery of hydrocarbons, as well as for the dynamic characterization of reservoirs. The main advantage of this invention is that it allows a greater certainty in the tracer response and a marked improvement in the sensitivity and quantitative analysis of the test results, since the curves fit both with mathematical models and numerical models. Another outstanding attraction of this invention is the reduction in the costs of testing such applications.

26 Claims, 9 Drawing Sheets

INTEGRAL ANALYSIS METHOD OF INTER-WELL TRACER TESTS

FIELD OF THE INVENTION

The present invention relates to an Integral analysis method of inter-well tracer tests, which integrates and performs continuous feedback to each of the major steps of such tests (design, operation and interpretation) allowing quantitative interpretation. It is a method to investigate the behavior of injection fluids for recovery of hydrocarbons, as well as for dynamic characterization of reservoirs. The main advantage of this invention is that it allows a greater certainty in the tracer response and a marked improvement in the sensitivity and quantitative analysis of the test results, since the resulting curves fit both mathematical models and numerical models. Another important aspect of this invention is the reduction in the costs of testing such applications.

BACKGROUND OF THE INVENTION

The main objective for the operational stage of an oil reservoir, from a technical-economic standpoint, is to obtain optimal recovery of hydrocarbons, i.e., maximize the economic value of the reservoir, so that the residual oil saturation is the smallest possible. To reduce this amount of the left over oil in the reservoir, it is used secondary and/or improved recovery processes, which consist primarily of fluid injection to provide additional energy and/or a favorable change of some properties of the rock-fluid system. The benefit would be a better displacement of oil towards producing wells, thereby increasing the recovery factor of the reservoir.

One of the most adverse factors to any fluid injection project is the presence of heterogeneities. The failure to timely detect them and therefore, not considering their influence on the project, can significantly reduce the likelihood of success of the same, and even lead to failure. Application of tracer tests between oil wells has recently gained prominence in the oil industry since this type of tracer tests is a good technique to investigate the behavior of the injection fluid flow in reservoirs and to determine the properties of the rock-fluid system that controls the gas and water displacement processes. The tracers have been used in many projects of secondary and tertiary recovery as a technique to quantify sweeping efficiencies and heterogeneities of the reservoir.

Tracer tests have been used to reduce the uncertainty attributed to communication between wells, horizontal and vertical flow and residual oil saturation. Based on a thorough review of the technical literature, it may be noted that the analysis of tracer tests has been mostly qualitative. As reported in the literature, it can be concluded that a poor sampling due to inadequate design is one of the main factors that leads that it does not obtain the expected results from the tracer tests. Also, it can be concluded that quantitative analysis of this type of tests is very limited, either analytical or numerical, and very few are reported with advanced numerical modeling. According to Y. Du and L. Guan, 2005, tracer tests between oil wells, most of them (61%) in a qualitative way, from the remainder (39%): 14% were analyzed by numerical methods and 25% with analytical analysis.

Several methods have been proposed to monitor the injected fluids for recovery of hydrocarbons, for example, U.S. Pat. No. 5,168,927 which discloses a method that provides a strong advance for tracers by injecting a relatively small amount volume of tracer at large pace, using a flow induced by production wells to transport the tracer; measurements of residual oil and sweeping can be obtained from this method. Another example is U.S. Pat. No. 4,099,565 which presents a method to obtain data useful in assessing the effectiveness or to design an improved recovery process by determining the hydrocarbon saturation in the formation. There is also U.S. Pat. No. 3,933,131 in which the oil flow path is monitored through the injection of a stable radical, or by spin level, within the reservoir as a tracer which becomes detectable in a sample taken from the producing well. Also, U.S. Pat. No. 4,273,187 in which a method is presented for determining the amount of recovery of petroleum chemicals retained within a reservoir through the collection of data from at least one injection-soaking-production cycle in a single well, the produced fluids are monitored through the chemical concentration of the produced fluid. Simulated cycles are repeated until the concentration of the chemical of simulated fluid produced is virtually the same concentration in the actual fluid produced. The amount of chemicals is then calculated by conventional techniques. Another method related to the present invention is U.S. Pat. No. 4,482,806 which discloses a method of registering a plurality of formations where first and second gamma radioactive tracers of different energy levels are introduced into the formation. The records are produced by tracers as traced fluids when passing through the formation and records are analyzed to determine changes in effective permeability and the sweeping of formations.

Recently, other methods have been presented relating to the present invention. For example, U.S. Pat. No. 7,472,748 proposes a method for determining more approximated properties of the formation and/or compression of the fracture, through fluid identity data for a plurality of return fluid samples; and using a reservoir model, with the fluid identity data and one or more properties of the reservoir. Another method is proposed in U.S. patent application US 2009/0211754 A1 in which a fluid can be tracked in a well using at least one WID label (wireless identification), such as a LW label (long wave length identification), entrained in the fluid. WID tag reader may be disposed and/or moved in the well, for example, a drill string or a casing string. A reader can be used to locate at least one WID tag in the well. A reader can be placed in the drill string (sub). A fluid entrained with at least one WID can be used as a tracer fluid.

In U.S. patent application US 2010/0006292 A1, methods and systems are described to stimulate oil wells. A method considers contacting the formation with a treatment fluid and monitoring the movement of the treatment fluid in the reservoir providing one or more sensors for measuring the temperature and the pressure, which is placed on a support adapted to maintain a given spacing between the sensor and the exit fluid. In some realizations, the support pipe is flexible.

Also mentioned is U.S. Pat. No. 5,072,387 which presents a method for determining the transit time of a radioactive tracer for determining the steam injection profiles. The radioactive decay data are collected in two detectors at different depths. Then the data is transformed to a new set of data comprising the time intervals between decay events. The arrival time of the tracer is determined as the first time in which a minimum detectable radiation is specified.

Additionally, it is also provided a method for characterizing reservoirs in U.S. Pat. No. 5,305,209 which presents a method for characterizing multi-layer reservoir through a single layer model representative of the flow parameters of a multilayer reservoir and developing a set of flow rate predictions from a numerical simulator. Differences between actual and simulated flow rates are automatically minimized to obtain the flow parameters for each layer of the multilayer reservoir.

However, given the experience gained to date in inter-well tracer tests, it is noted that the analysis is difficult because there are no complete design methods which integrate elements such as analytical and numerical modeling that allow predictions and based on these achievements to get a better design. Nor is there any method that integrates all stages of a tracer test (design, operation and interpretation). In the absence of these key elements in the design stage, it is likely that tracer test will not produce the expected results for some of the following relevant points: i) poor selection of injector well, ii) Inadequate tracer, both type and quantity, iii) poor selection of the wells monitored, either in number and in areas, iv) poor sampling program, among others. These unsubstantiated designs of tests lead to scarce tracer responses and is not possible to obtain useful information from them. As a consequence, it is impossible to obtain response curves from the tracer which may be interpreted or possible to perform a quantitative analysis thereof. Incorporation of a tracer activity measurement system on line gives new elements which allow successful testing of tracers. These elements are, for example, a continuous measurement of tracer passing through the production line, that is, the absence of data is completely eliminated; human errors are avoided in the time to time sampling, problems caused by climate or by bad weather are also eliminated, as well as not having data in critical test times, etc.

Also, it is noted that analytical modeling may be difficult because representative models of tracers flowing through porous media are not known. At this point, it is also important to mention that a significant percentage of reservoirs worldwide (geothermal and hydrocarbons) are found in naturally fractured formations, and most of the available modeling tracer tests in porous media are not applicable to this type of reservoir, due to the high heterogeneity of the same and all the processes that can occur when the tracer moves through fractured porous media; macroscopic processes, such as convection and dispersion, and microscopic such as diffusion, chemical reaction, ion exchange, adsorption and radioactive decay, which may be present and must be considered in the analysis.

Quantitative analysis of tracer tests depends on the ability to properly describe all processes that influence tracer travel throughout the reservoir.

Similarly, applicants do mention that one of the main problems that arises in interpreting the results of a tracer test are the result of poor and/or insufficient monitoring program. This, according to reports from Du, 2005, primarily is due to inadequate design. Also, it can be attributed to inadequate operation (one or more of the design parameters are not satisfied). This may be from an inappropriate injection, the amount of tracer injected is not verified, samples are not collected in accordance with the program, whether for climate type issues or other simpler issues, and these changes are not considered in the interpretation of the test.

Therefore, one object of the present invention is to provide to special elements necessary to enable integral analysis of tracer tests, considered from the test design up to its interpretation, leading to the determination of properties of the reservoir (including connectivity between wells, existence of barriers and/or conductive faults, etc.) and the global behavior of injection fluids, as well as improvement of the numerical model of the field in the zone involved in the test.

Further, another object of the present invention is to provide a method intended to meet the requirement of having an Integral analysis method of inter-well tracer tests which considers each of the relevant aspects mentioned above, which is based on the dynamic interaction between the modules of design, operation and interpretation, as well as the work lines conforming such modules.

Thus, through the use of the present invention, valuable information can be obtained from this type of testing, so that its consideration in the fluid injection processes tends to increase secondary or tertiary production of hydrocarbons.

The application of the method presented here allows the user an integral analysis of tracer tests, both qualitatively and quantitatively, as are additional elements that impact a highly supported, systematic and integral analysis.

BRIEF DESCRIPTION OF THE DRAWINGS

The following figures are presented with the purpose of clearly understanding the Integral analysis method of inter-well tracer tests.

DETAILED DESCRIPTION OF THE INVENTION

The present invention relates to a method of integral analysis of tracer tests between oil wells (design, operation and interpretation), as one element to investigate the behavior of the flow of injection fluid in the reservoirs so as to determine the properties of the rock-fluid system that controls the displacement processes of gas and water in secondary and/or improved recovery projects. To perform the integral analysis, it is necessary a computing equipment to make the corresponding simulations with the purpose of design and interpret the tracer tests, apparatus for measuring the concentration of the tracer, as well as algorithms for determining physical properties of the reservoir. A central part of this invention is to use the Online Measurement System (OMS) in wellhead connected to the hydrocarbon production line. This system measures the concentration of tracer being produced by the well.

The analysis of tracer tests requires a procedure embracing the design of the test, a reliable measurement of the tracer(s) produced in the observer wells, the use of one or several mathematical models representing the tracer flow in porous media, one or several optimization methods to determine the parameters involved in the process, numerical simulation of the process and interpretation of the study leading to show a single image of the reservoir, integrating the available information sources. The SML plays a determining role because it is a reliable measurement equipment which is capable of measuring the concentration of tracer in real time, which has the benefit over traditional sampling that measures continuously, thereby, preventing extrapolation and interpolation errors in the response curve of tracer(s). With the use of SML, costs associated with collecting and radiochemical analyzing samples are substantively reduced.

For any analysis of tracer tests, it is necessary to work under a scheme of dynamic interaction between lines of work for the nature of these lines requires the feedback between them.

Figure 1:
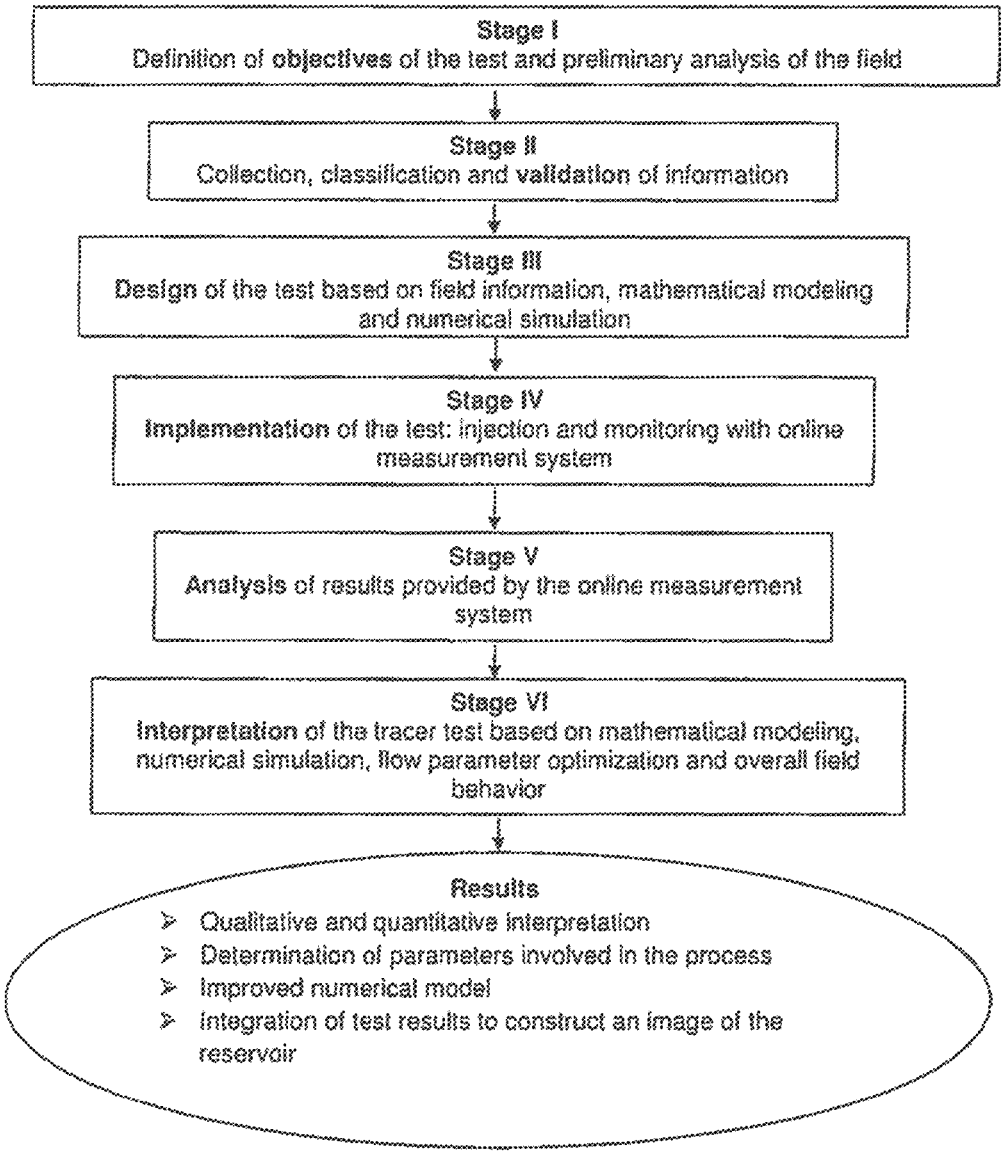
FIG. 1 shows the schematic of the Integral analysis method of inter-well tracer tests in the present invention.

FIG. 1 presents a flowchart of the method summarized of the integral analysis of tracer tests which have the sequence of major steps, same as described briefly below:

STAGE 1. Definition of Test Objectives and Preliminary Analysis of the Field.

At this stage, test objectives are defined as accurately as possible as well as the scope of study by those who seek tracer test and the person responsible for the entire test and, likewise, the establishment of guidelines governing during development. Also, at this stage, it is necessary to perform a preliminary analysis of the field to define the reservoir characteristics and problems inherent in its production history, its geology and possible future operating solutions, which is achieved through general analysis of the following:

Regional context of the reservoir

Geological, geophysical and fluid dynamics in the reservoir.

Analysis of operation conditions (historical, pressure, production).

Analysis of the problems identified at the reservoir.

Analysis of operations to be performed in the reservoir.

Figure 2:
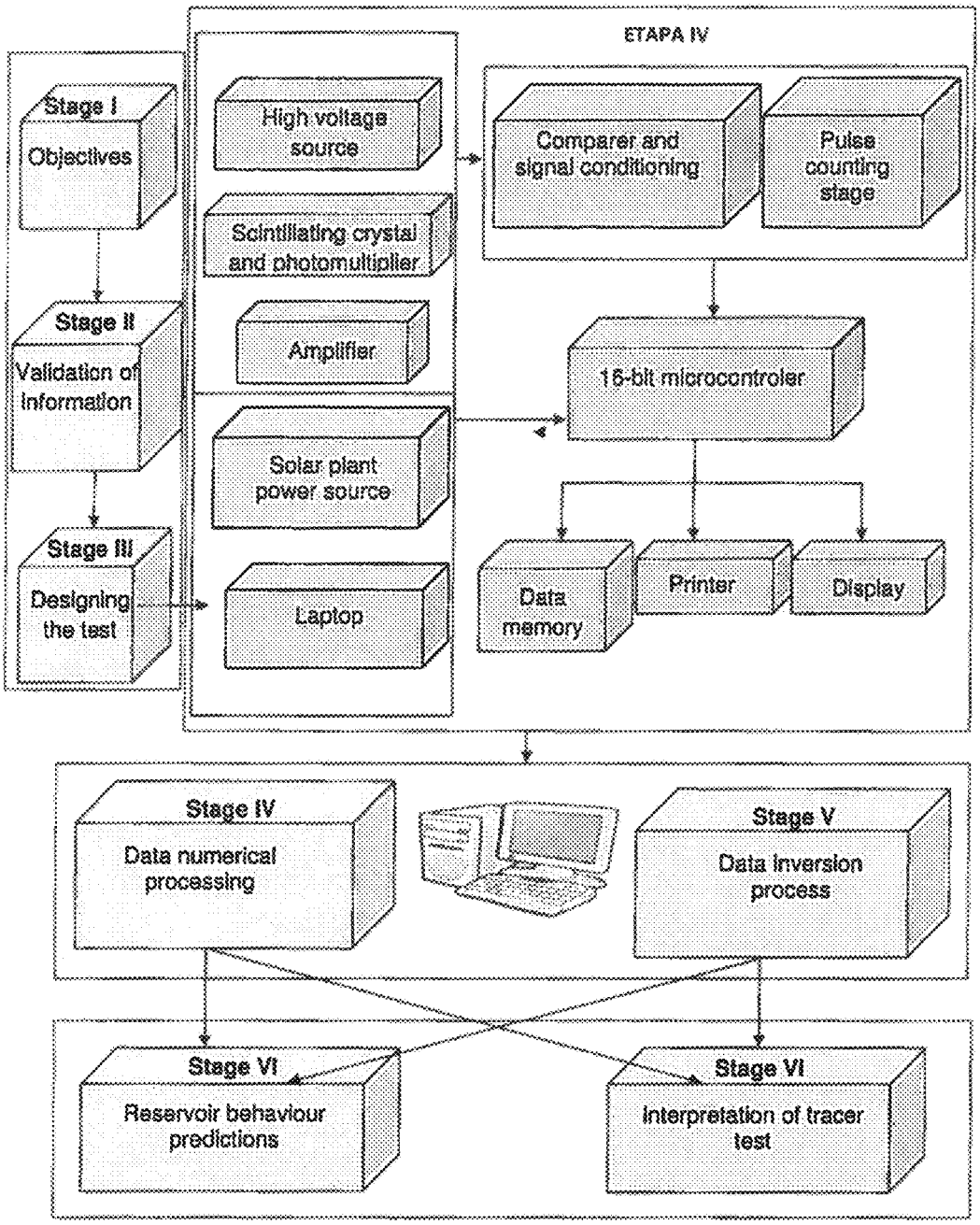
FIG. 2 shows the block diagram of the Integral analysis method of inter-well tracer tests.

In the block diagram of the method of integral analysis of inter-well tracer tests, it can see the test objectives are defined and the preliminary analysis of the field, point of departure of this methodology, and this stage also serves as an input for Stage II (see FIG. 2).

Stage II. Collection, Classification and Validation of Information.

All available information of the reservoir of interest is validated, sorted and a database is prepared. These activities are carried out both by specialized personnel that requested the test and by those who will classify and validate the information. The scope of the study will depend upon the quality, quantity and availability of the information.

The information forming the database will consist of: location map of the field, coordinates of the wells, geological columns, geological model for the reservoir, drilling logs, well pressure and production data, PVT analysis reports of fluid samples, petrophysical analysis reports of reservoir rock samples, mechanical condition of the wells, report of interventions performed in wells, reports of borehole measurements per well, numerical simulation model of the reservoir and, in general, several studies reporting previous studies of the area of interest related to the above mentioned aspects. After the validation of information doing, it is passed directly to the test design, Stage III (see FIG. 2).

Stage III. Test Design Based on Field Data, Mathematical Modeling and Numerical Simulation.

The design procedure of the test of the present invention consists of several stages. As a first phase arises traditional design (based on the total dilution method), which then expands and supports significantly, considering analytical models that allow predictions, and then applying numerical simulation, which is performed on a computer that has an oil reservoir simulator, to know the global dynamics of the flow in the field and enter the behavior of tracers in the specific conditions of the test. It is noteworthy that, while the results are obtained for each phase, the remaining stages are feedback as appropriate. Finally, integrating all this information the final design of the test is generated.

Figure 3:
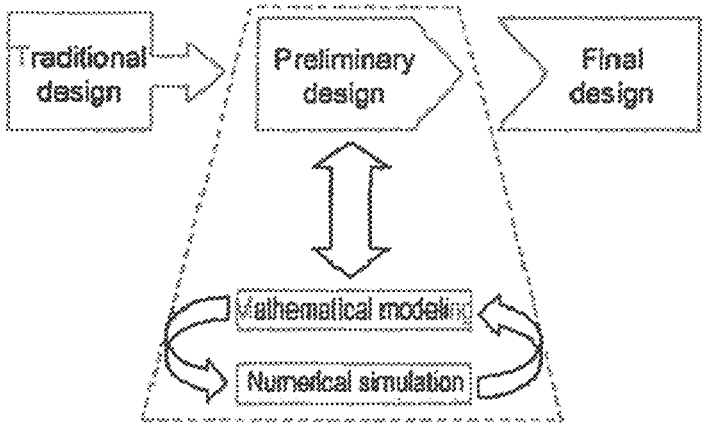
FIG. 3 shows the design methodology of a tracer test of the present invention.

The test design methodology is illustrated schematically in FIG. 3. It is summarized in blocks the necessary activities to obtain a final design supported by mathematical modeling and numerical simulation of the test. The blocks can be described briefly through the following phases:

Phase III.1.

Preparation of preliminary design based on field information, evaluation, selection and estimation of the amount of tracer (by total dilution method).

Phase III.2.

Mathematical modeling, selection and implementation of mathematical model(s) representative of the reservoir.

Phase III.3.

Numerical Simulation, application of the field numerical model to obtain predictions for the previous phase (since this model may be in a commercial platform or in a simulator created expressly for this purpose). Results reported by numerical simulation are analyzed.

Phase III.4.

Adaptation of preliminary design and application of mathematical models with the new design.

Phase III.5.

Development of final design, taking the results of the interaction between mathematical modeling and numerical simulation of the test in which the type of tracer is included.

The advantage of this methodology would be that predictions based on a preliminary design are made with models representative of the flow of tracers in porous media, i.e., it can be tested arrival times and concentrations arriving to the wells of interest in a simple way. It should be noted that these predictions are made on the basis of validated field information, for example, porosity, surface distance between the wells involved, dispersion coefficients, etc. Also predictions are made considering virtually all phenomena that occur in the field and real operating conditions through the numerical simulation of the test with the design obtained from mathematical modeling. Based on the results of the simulation of the test, they are obtained a design of the test based on static and dynamic models of the reservoir so that the monitoring wells are selected as well as the sampling program and the amount of tracer to be injected. Given the above, this design procedure avoids some of the problems that tracer tests show currently as a result of inadequate design.

STAGE IV. Implementation of the Test: Injection and Monitoring of Tracer with the Online Measurement System (SML, Sistema De Medición En Linea).

The final design is the basis for the execution of the test, it is necessary to attempt to comply as closely as possible with the provisions of the design. It requires constant contact with operation personnel since it can present several problems that have to be resolved by the staff who designed the test.

Stage IV is depicted in FIG. 2. This figure shows that, in the section on this stage (upper right of the figure), each of the internal elements that make up the Online Measurement System (OMS) are shown with which the measurements of the tracer(s) produced in the well are performed. From here, you can see that the elements of this system are: high voltage source, scintillation crystal and photomultiplier, amplifier, solar plant for energy, laptop, comparator and signal conditioning, 16-bit microcontroller, data memory, printer and display.

Figure 4:
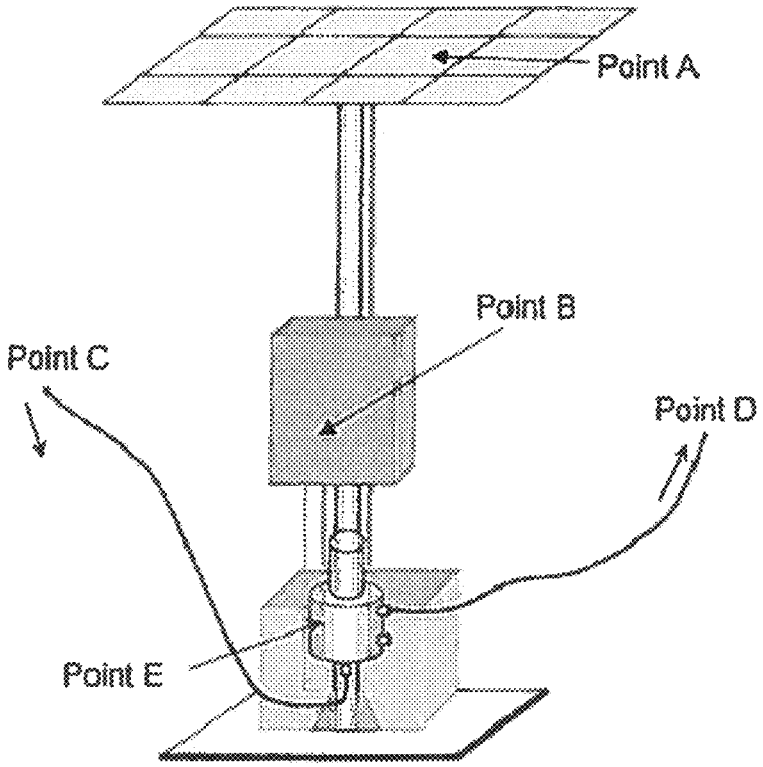
FIG. 4 is the scheme of the online measurement system of tracer concentration.

FIG. 4 shows an exterior view of the main components in the SML. This figure shows the solar cell, Point A, which makes autonomous supply system, the cables that carry power to the batteries (bottom of the figure), the data control cabinet, Point B, as well as hoses to supply fluid flow from the well head, Point C, and the hose section of the fluid outlet system, Point D, which are incorporated in the discharge line of the well (downspout). Also, in this scheme, it can be seen the detection and measurement device of tracer Point E, whose main element is the liquid crystal scintillator.

Figure 5:
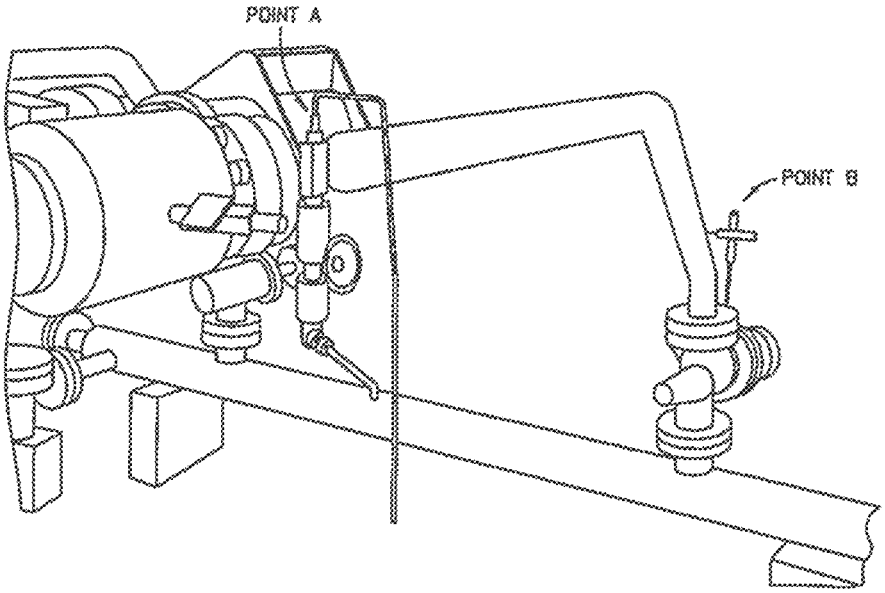
FIG. 5 shows the downspout line of the well where the measurement system is connected.

FIG. 5 shows the surface facilities of a ground well, where the production line of the well is present, and the points where SML is connected via a thin steel pipe, tubing (resistant to high pressure and high temperature). Part of the fluid from the reservoir is taken at Point A. The fluids are taken from the production line, are led through this pipe into the SML and to output of measurement system, fluids are then reincorporated into the fluid line from the well at Point B as illustrated in this figure, known as the downspout hole. Note that after installing the system, the flow is continuous and, therefore, the measurement is continuous and it does not require staff or laboratory for sampling. The measurement is taken when the flow is passing through the system. The SML detection window is programmable so it can be either every minute, four, eight, etc.

Here are briefly the activities required to properly implement a tracer test:

1. Review of mechanical condition of wells involved, both injectors and producers.
2. Calculating the capacity of the pipe and the displacement volume of injection fluid.
3. Sampling prior to injection of the tracer.
4. Injection of tracer(s).
5. Monitoring radioactivity in the system.
6. Changing the measurement window if it were necessary.

Stage V. Analysis of the Results Provided by the Online Measurement System.

FIG. 2 shows that Stage V requires a computer to perform both numerical processing of data and inversion process of data obtained with OMS. The numerical process of data first consists of making a qualitative data filter. The inversion process of data lies in obtaining the physical parameters of the reservoir based on concentration measured with the OMS. For both the numerical process of data and inversion process of data, computer equipment is required.

In this Stage V, a verification of results is performed, the results are analyzed to see if they are congruent per well contrasted with the field log. After these validated, it is proceed to determine the concentrations obtained based on the flow rate of the producing wells. The main phases of this stage are:

Phase V.1.

Curves from the online measuring system are analyzed. First plot the data from the SML, quantify the background radiation in order to eliminate it. Calculate the activity of tracer that has arrived at the wellhead in order to estimate the amount of activity that has come out and that still remain in the formation. This also requires full communication between those operating the SML and who coordinates tracer tests since the latter is the one who will decide on the following based on the results of the first stage of analysis.

Phase V.2.

In preparing the SML reports, it should be taken into account the inclusion of all the parameters that specialists who will perform the tests require to know. At this point, those specialists should indicate all required information for interpretation.

STAGE VI. Interpretation of Tracer Test Based on Mathematical Modeling, Numerical Simulation, Optimization of the Flow Parameters and the Overall Behavior of the Field.

Stage VI is the latest stage of the Integral analysis method of inter-well tracer tests (see FIG. 2). This stage is carried out by highly qualified personnel in the interpretation of tracer tests following the steps listed below.

It is here where all the previous efforts converge, and is the final stage of the test. It should be noted that there are two levels of interpretation of tracer tests: i) Qualitative interpretation and ii) quantitative interpretation. This invention presents an integral method for interpreting qualitative and quantitative tracer tests between oil wells. In this final phase of testing different activities are performed. First, compare the curves obtained in the design stage of the test (curves corresponding to predictions of the behavior of the tracer, either through mathematical modeling and the numerical simulation) with the tracer response curves obtained from samples of each well.

From mathematical modeling, it can be obtained parameters of the rock-fluid system, like "actual" average speeds of transport, and some parameters (as the physical phenomena considered by the mathematical model used) as: hydraulic dispersion, actual distance traveled, dispersion coefficient, fracture width, porosity of the matrix, porosity of the fracture, among others, all obtained from the adjustment of the tracer response curves and the prediction model. Also, an estimate of the tracer recovered in question and the amount of tracer that was left in the reservoir. Also at this stage preferential flow directions are established according to the arrivals of the tracer in the wells in the field, swept volumes, the mass balance of tracer and duration of the test.

From the numerical simulation, it can be obtained preferential flow directions, arrivals of tracer, balance of material for long times, according to the scheme of exploitation of the field, permeability (numerical model data) that do not necessarily coincide with the "real" therefore it is necessary to perform a adequacy of the numerical model, in terms of permeability and the relationship according to the case, identify "waterproof" barriers that are not, and other barriers that do prevent fluid flow which have not been included in the geological model.

The proposed methodology for Stage VI, i.e., the integral interpretation of inter-well tracer tests is summarized below using the following procedure:

Phase VI.1.

Review of the original objectives of the tracer test. it can be either every minute, four, eight, etc. the design parameters, including the sampling program, analysis and consideration in the interpretation of their differences, if any.

Phase VI.3.

Determination of differences with the mathematical model. It is also very useful to establish the differences between the field data and the behavior of the tracer obtained by a mathematical model. Because the mathematical model is compared based on the field data according to Stage II, the difference between the two are likely to focus on the adjustment of the shape of the curve. When there are several solutions to the inverse problem, it is possible to have several adjustment curves, the selection of the optimum curve will be based on the section of the data with increased reliability.

Phase VI.4.

Calculation of tracer recovered activity. To calculate the activity of recovered tracer it is required to perform the following integral, $$R(t)=\int_0^t Q(t)C(\tau)d\tau,$$

where Q(t) is the flow rate of the fluid passing through the downspout and the concentration of tracer measured by SML.

With this calculation, it can be assessed the amount of tracer that is out of the reservoir and therefore how much tracer remains in the formation. According to the tracer activity measured instantaneously it can be decided to continue sampling or stop acquisition of data, for example, if the concentration being measured is the same which correspond to the background radiation, this would be a good criterion to stop monitoring.

These data must be processed further because you have to take into account the conditions of the test. The production flow rate is an important factor in the quantification of the tracer to be taken into account. This production flow rate must be strictly a function of time, although in practice it is considered piecewise constant.

Phase VI.5.

Inverse problem. Determination of the physical parameters involved. To determinate the physical parameters it is necessary to use field data, an appropriate mathematical model and starting point beside a non-linear optimization method. The presence of several peaks may be generally due to the presence of several producing layers, thereby it should be searched to isolate the corresponding data for each peak and make an adjustment for each peak (for treatment of curves with multiple peaks it is also advisable to use models of several wells, see, e.g., Abbaszadeh and Brigham, 1984).

Figure 6:
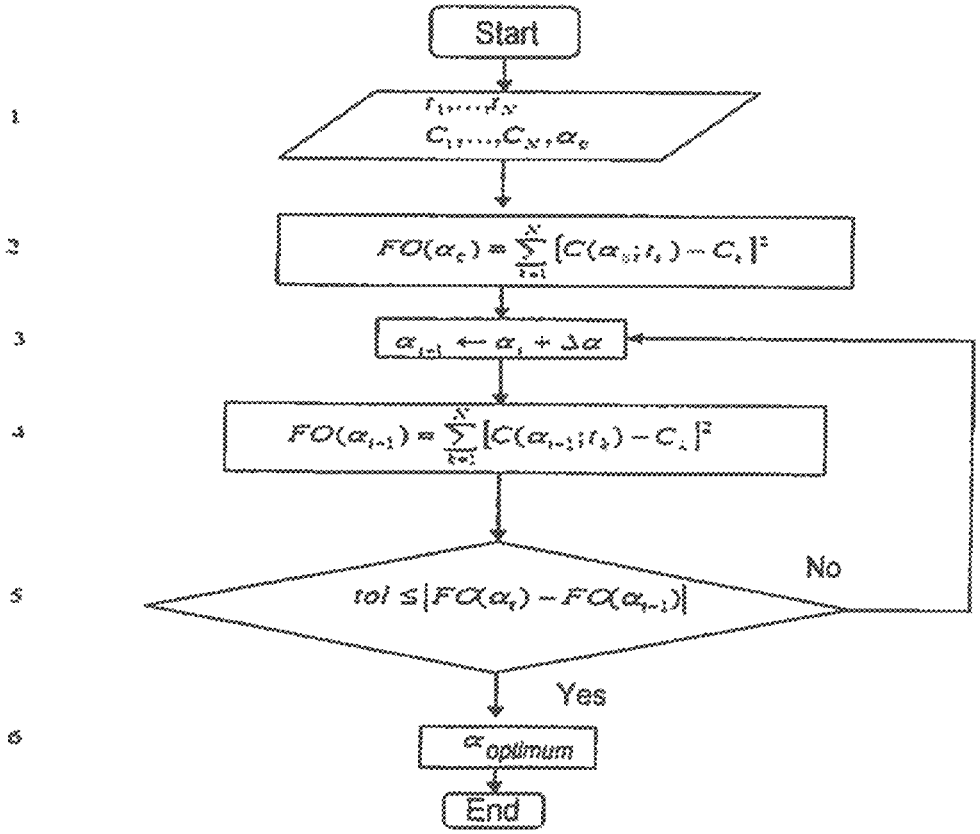
FIG. 6 shows the procedure for optimizing the physical parameters involved in the process of the present invention.

FIG. 6 represents the procedure followed for this Phase VI.5. Inverse problem is an optimization process of parameters involved in the mathematical models, outlined in a flow diagram. Each block is detailed below.

1. The input values are tracer concentration values measured with the SML at different times. Here it should be noted that a major problem that it is had in the interpretation of tracer tests is the limited data obtained from samples taken and analyzed (it is common to try to lower the costs of this kind of tests by reducing the sampling program to a minimum), and with this method and the SML line connected to the production of hydrocarbons this problem is virtually eliminated because the measurement of tracer is nearly continuous. Thus, there is N number of data pairs. It is also required as starting data $\alpha_0$ that represents the set of physical parameters to be optimized and its initial value. $\alpha_0$ is indispensable because it is from this value that the nonlinear optimization method starts searching for the nearest optimal. Generally the initial value of the parameters is collected from other field tests.

2. The objective function is defined in the least squares sense that is constructed as the sum of the squared differences between what the mathematical model predicts $C(\alpha; t_k)$ and the measured data of the concentration $C_k$ for each time point $t_k$. The mathematical model to be used depends on the type of reservoir. There are models describing tracer transport in homogeneous reservoirs, in fractured reservoirs, with a radial geometry that can be homogeneous of fractured. It should be noted that some of the mathematical models are in real space, but the vast majority are in Laplace space. In the latter, besides the model it is also required a numerical inversion algorithm to evaluate the function in the Laplace domain so as to pass it to real domain. Objective function is evaluated for the first time because it is required in block 5 of FIG. 8 to verify that the requested tolerance has been accomplished.

3. This step improves the set of parameters to be optimized by $\Delta\alpha$. This change of parameters to be optimized is related to the optimization method employed. The goal of the optimization methods is approximate the optimum in each step by mean of a better $\alpha$. Sometimes the gradient is used, others, the Hessian, and in others only evaluation of the objective function. A better set of parameters are obtained in each iteration.

4. Again the objective function is evaluated in improved state, i.e. in $\alpha_{i+1}$. By the very nature of the optimization methods this new set of parameters will be closer to the optimum.

5. The criterion for completion of the process to obtain optimized parameters is when the difference between consecutive values of the objective function (i.e., evaluated in $\alpha_i$ and in $\alpha_{i+1}$) is less than a certain requested tolerance. This implies that there is no substantial improvement between two consecutive values of a.

6. In this way the optimum value of the physical parameters is reached, which is stored in $\alpha_{optimum}$.

Based on these values a quantitative analysis of a tracer test is performed.

Phase VI.6.

Determination of the swept volume. Sweeping volume is calculated from the response curve of the tracer in terms of volumes produced. The concentration of the tracer is plotted versus the produced volume. Sweeping volume is determined multiplying the mean volume produced by the ratio between flow rates of injector well and producer well, i.e.:

$$V_s = \langle V_p \rangle \frac{Q_{ip}}{Q_p}$$

where $\langle V_p \rangle$ is the mean volume produced, which is calculated from the first moment of the tracer concentration curve produced, C, as a function of the volume produced, $V_p$, that is:

$$\langle V_p \rangle = \frac{\int_0^\infty V_p C(V_p) dV_p}{\int_0^\infty C(V_p) dV_p},$$

and $Q_{ip}$ is the rhythm of the flow between injector and producer wells, which is determined from the fraction of tracer produced in the well and the mean flow rate of injection $Q_i$. The value of $Q_i$ is given by:

$$Q_{ip}=Q_i(m/M).$$

Here m is the amount of tracer produced in a given well and M is the amount of injected tracer.

Phase VI.7.

Establishment of dicrepancies with the numerical simulation. This step should establish as clearly as possible the major discrepancies between test results and numerical simulation. That is, the main flow of tracer measured (time of irruption and reported mass or radioactive activity) with respect to the prediction of the simulator. With the above it can be estimated the preferential directions of flow (real, corresponding to measurements and simulated). The fact that there is not concordance between the results of field and simulation results, is itself a useful result because it will be had to assess whether it is necessary or not a full review of the corresponding numerical model of the field.

It should be mentioned that it is important to know which are the tracer transport phenomena considered in the flow equations of the simulator, in order to understand the behavior of the tracer in the porous medium, and thus establish the reason for the differences reported in tracer responses (real and simulated).

Phase VI. 8.

Determination of an "equivalent" permeability per area. With predictions of the numerical simulation it is possible to obtain "equivalent" permeabilities in the area of study, injector-producer well, of each tracer irruption observed in the field. The procedure is as follows:

Determine the output file predicted by the simulator "fit" as close as possible to the test results, background pressures corresponding to wells involved in the study plot. These should be referred to the same plane and to the dates involved. With these pressures and the distance between wells, are obtained the pressure gradients established in the reservoir, so that the velocity obtained from the test, the viscosity of the fluid and the flow cross section (reported by the simulator) it is possible to obtain an "equivalent" permeability of the behavior obtained in the test. This permeability would be the one used in the simulator in that zone.

Phase VI.9.

Determination of the mass balance of the tracer. The tracer mass balance is estimated from field data, mathematical modeling and numerical simulation.

From the test data construction of graphs are made, total produced tracer, i.e., cumulative curves of tracer per well and per field. The difference between the total produced tracer per field and the injected tracer represents the tracer that remains in the porous medium. This indicates the volume of injection fluid that is distributed in the reservoir. Significantly, often duration of sampling program is not long enough to obtain tracer production that it would be obtained in long term, whether per well or per field. Through predictions from mathematical models, it is possible to determine the tracer production in long term, so completing the information obtained from curve fitting better information on the mass balance of the tracer.

Moreover, from the "adjusted" predictions of the numerical simulation it is obtained the mass balance of the tracer, which determines the amount of tracer that remains in the porous medium, and a follow up can be made even in the phase where it is found through the following variables:

FTIPTTR1→Field Tracer In Place Total of Tracer TR1

FTIPFTR1→Field Tracer In Place Free of TR1

FTIPSTR1→Field Tracer In Place Solution of TR1

FTPTTR1→Field Tracer Production Total of TR1, such that: FTIPTTR1=FTIPFTR1+FTIPSTR1;

The balance is met when the difference (FTIPTTR1+FTIPTTR1) is equal to the mass of tracer injected. These variables are obtained at each time step, such that predictions can be made until complete the total tracer produced at the time of the test and until no changes are reported on arrivals of tracer and increased production of tracer in wells. With this, it is possible to determine the overall behavior of tracer on times that otherwise are not economically permissible.

EXAMPLE

The following application example is presented to illustrate the Integral analysis method of inter-well tracer tests. It is worth mentioning that according to the study in question, it will be required or not to follow each stage involved in the process, i.e. there will be cases of fields in the study which do not have the necessary information to apply this or that stage, as the numerical model of the reservoir, if so, it is obvious that they would have to eliminate the numerical simulation stage. This section is intended to illustrate the most significant stages of this method. It is noted that this example should not be considered as a limitation of what is claimed here, but merely discloses the best way to use the present invention.

The study takes the example corresponding to the case of a reservoir programmed for an improved recovery process and the specialists require a tracer test in order to obtain information about injected fluid behavior. This reservoir has a validated numerical model and corresponds to one of the Mexico's offshore fields.

Note: In order to improve the explanation of the application of this method of analysis, hereinafter the notation used is Ex.Stage I, Ex.Stage II, etc., referring to the stage in question applied to the Example. As well as Ex.Phase.III.1, Ex.Phase.III.2, etc. to refer to Phase 1 and Phase 2 of Stage III, respectively, of the example of the application.

In order to present the substantive activities of this invention it is only presented the novel stages of the method of analysis.

After the Ex.Stages I and II are performed, it is proceed to Ex.Stage III, corresponding to the test design.

Ex.Stage III. Design of the Test Based on Field Information, Mathematical Model and Numerical Simulation (See FIG. 3).

This stage consists of 5 phases that are briefly described below:

Ex.Phase.III.1.

Preparation of preliminary design based on field information, evaluation, selection and estimation of the amount of tracer. This phase follows the traditional procedure, the total dilution method, which is based on marking a volume equal to the volume of hydrocarbon known in the reservoir. In the present invention this design is taken as preliminary design of the test, see FIG. 3.

Evaluation, Selection and estimation of the amount of tracer: based on information in the field and improved recovery process scheduled for the reservoir in question and the availability, measurement capacity, costs and limits of detection and security, the tracer(s) to be injected are selected. In the previous phase the necessary amount of tracer is determined.

Ex.Phase III.2.

Mathematical modeling, selection and application of representative model(s) of the reservoir. At this phase the more representative mathematical models of tracer flow are selected according to the field in question. With such models, predictions are performed about the behavior of the tracers if they were injected in one well and observed in other well(s). The sum of accumulated concentration values obtained with these models in the observation wells is compared to the injection concentration estimated in the preliminary design phase. This allows the first feedback between traditional design and design based in mathematical modeling.

Figure 7:
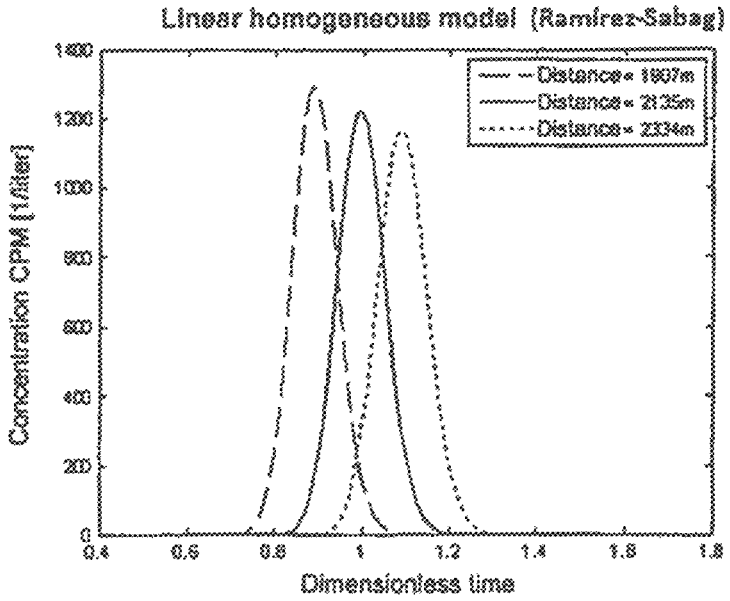
FIG. 7 illustrates predictions of tracer responses in different wells located at different distances (L), obtained with the Linear Homogeneous Model, J. Ramirez-Sabag, (1988).
Figure 8:
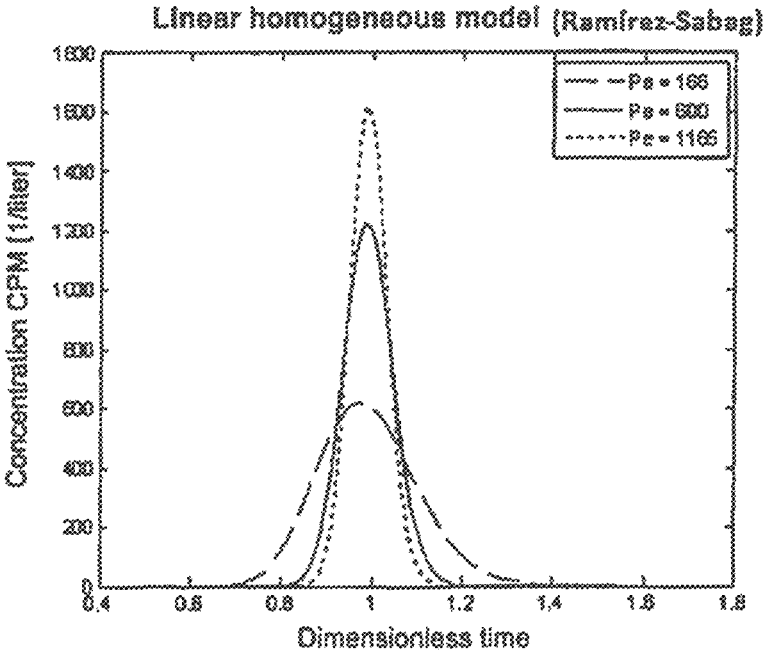
FIG. 8 shows the tracer concentration curves obtained with the Linear Homogeneous Model, by J. Ramirez-Sabag, (1988), for different values of Peclet numbers.

FIGS. 7 and 8 illustrate the mathematical modeling phase, applying the model of J. Ramirez-Sabag, (1988), where Eq. (2) represents the tracer flow in a homogeneous reservoir for different values of the physical parameters involved. FIG. 7 shows the arrival of tracer to three different wells located at 1907 m, 2135 m and 2334 m. As it can be appreciated and it is expected, the farther is the observer well, the arrival time is greater. Otherwise these arrival times decrease. FIG. 8 shows tracer response based on different values of Peclet number. The Peclet number represents how much the fluid is dispersed in the porous medium. As shown for Pe=1165 upwelling curve of tracer is very thin, whereas for Pe=600 and Pe=166 the response curves tend to widen. Likewise this figure shows that the higher the value of Pe, the maximum concentration of tracer increases, and conversely, the lower value of Pe, the maximum concentration decreases.

Ex. Phase III.3. Numerical Simulation.

In this phase the field numerical model is applied with the purpose of simulating the tracer test designed in the previous phase. It is noted that it is recommended the numerical simulation platform of reservoirs in which the field numerical model in question is built.

Figure 9:
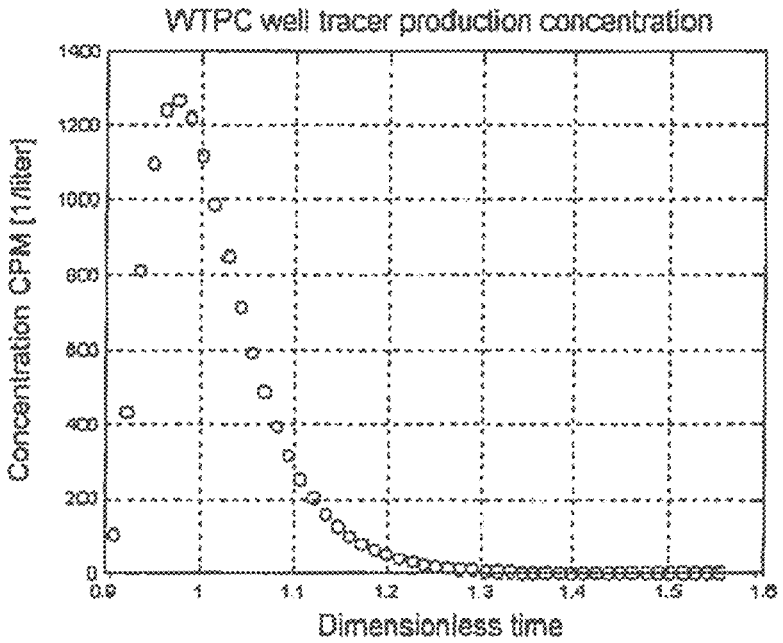
FIG. 9 shows the concentration data obtained from compositional simulator in which the concentration produced in the monitored well is used as a variable, WTPC (Well Tracer Production Concentration).
Figure 10:
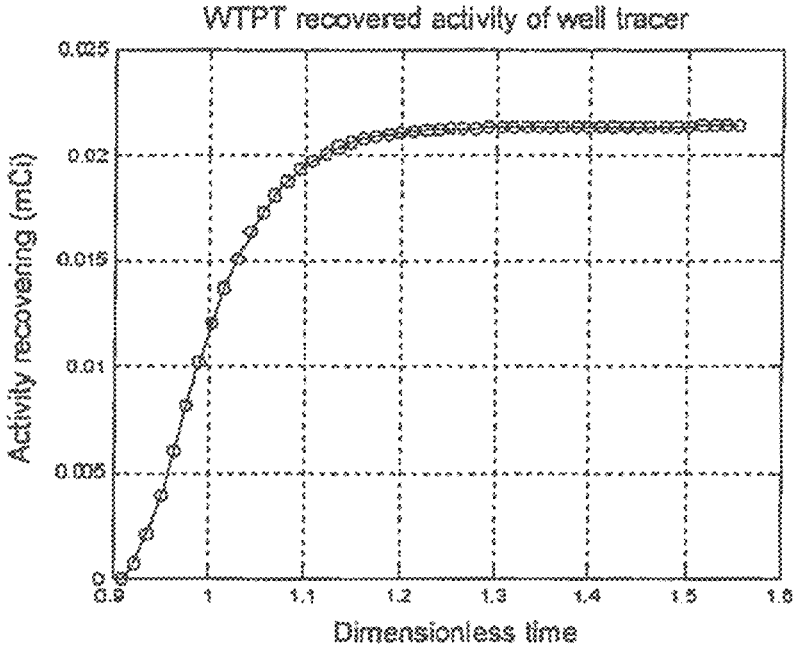
FIG. 10 shows the recovered activity obtained from the simulator using the variable of accumulated production per well, WTPT (Well Tracer Production Total).

FIG. 9 shows, as an example, a graph of concentration versus time, obtained from the simulation of the test developed in the previous phase, using a compositional simulator in which as a variable the concentration produced in the well monitored is used, WTPC (Well Tracer Production Concentration). FIG. 10 is an example of a graph obtained with the same simulator, using the accumulated production per well variable WTPT (Well Tracer Production Total).

It is very likely that differences occur between the field curve of tracer response (C vs. t) and the one reported by the simulator. Such differences may relate to irruption times, concentrations, and/or the behavior of tracer. It is just based on these differences, e.g. arrival times, maximum concentration, etc., that the interpretation stage appears, which is explained below.

Adjustments will depend on the comparison of the curves by the simulator and the resulting curves of SML (observed data in each well). According to the first results it will be made the appropriate changes in the data file, basically changes in time running, economical restrictions, producing wells that have been closed or open, for example. When the conditions under which the test was represented in the numerical model are the same, the curves reported with predictions made with the aforementioned changes will form the basis for the interpretation of the test.

From the breakthrough curves of tracer per well, it is possible to determine times of arrival, middle and end of the test; this latter when the tracer injected into the observation well is no longer detected of it is no longer necessary to continue monitoring with the SML, which is the final part of the curve in FIG. 9. With these times it is estimated duration of the test.

Another important contribution to the numerical simulation of the tracer test is contributing with useful information to the mathematical modeling of tracer behavior in the porous medium, such as water shortages, the oil and gas production per well, necessary for predicting daily concentrations of tracer that would be obtained from each well involved in the study area. Above all, the numerical simulation allows knowing the pressure gradients established in the reservoir by the injection conditions, production and characteristics of rock-fluid system. Known pressure gradients between the injector and producer wells, calculate the average speed of the fluid, necessary for determining the dispersion coefficient as well as the Peclet number, parameters considered in most models representative of the behavior of the tracer in the porous medium. So it is necessary to evaluate again mathematical models with data obtained from predictions of the numerical model of reservoir.

Ex.Phase III.5.

Figure 11:
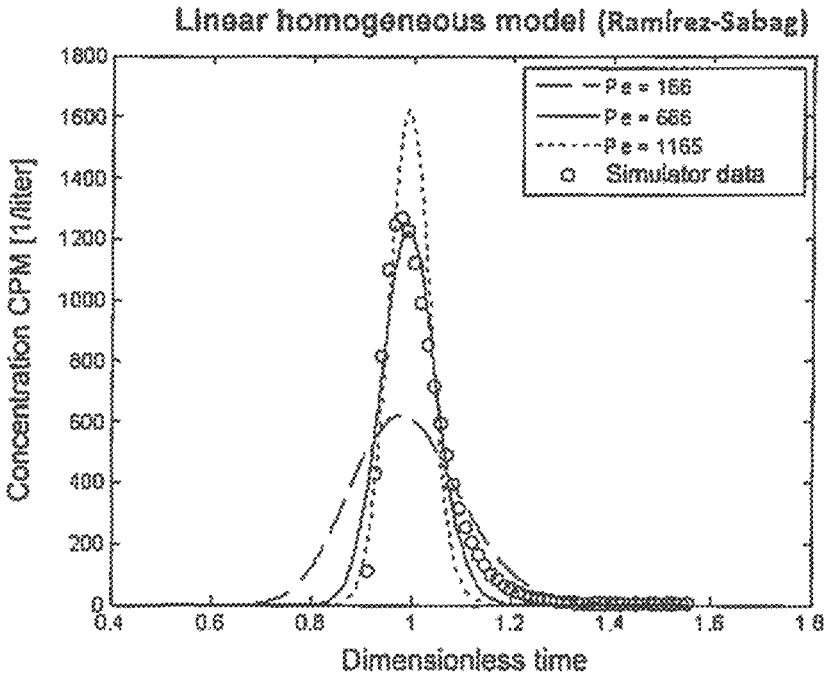
FIG. 11 shows the data obtained from simulator and values obtained with the linear homogeneous model for different Peclet values.

Development of the final design taking the results of the interaction between mathematical modeling and numerical simulation of the test in which the tracer is included. Based on the results obtained from numerical simulator, it is possible to feedback mathematical modeling in order to have a better test design. Once the predictions of numerical simulation and mathematical modeling were made, it is possible to compare the responses of each tool, thereby achieving a substantial improvement to the preliminary design that was obtained in the previous phase. For example, FIG. 11 shows the comparison of the corresponding graphs of FIGS. 8 and 9, which were obtained by mathematical modeling and numerical simulation, respectively. From this comparison it can be seen that the value of the Peclet number closest to the tracer response obtained with the numerical model of the field under study is Pe=666.

Figure 12:
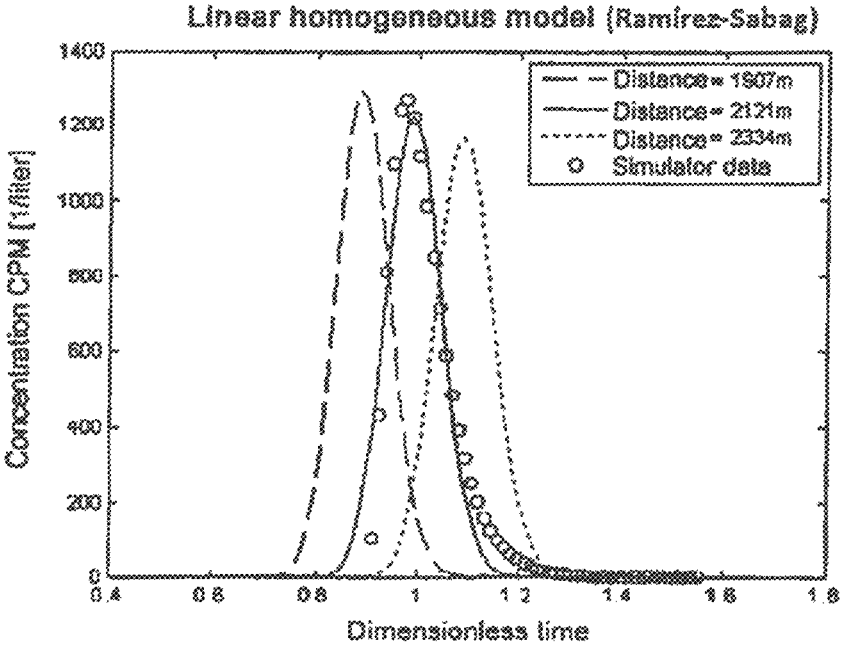
FIG. 12 illustrates the results obtained with the Lineal Homogeneous Model for three different wells and data calculated by the simulator.

FIG. 12 shows a comparison of predictions of these two techniques, but to estimate the most appropriate distance, which as can be seen from the figure, is that which corresponds to the distance of 2121 m.

With the results of mathematical modeling and numerical simulation, it is reached to the final design of the test, which must specify: type of tracer (s), quantity of tracer(s), injection rate, injection dilution, injection and monitoring wells, reporting test predictions. In the present example, it was achieved a final design, which considers more tracer to that considered in the preliminary design, additional monitoring wells, they were not considered in the preliminary design as they were out of focus areas (circles of influence of the test). Additionally, it is emphasized that the sampling program was designed based on the critical times of arrivals of tracer, given by the analytical predictions which in turn were fed back to the numerical simulation results. So at this stage it is concluded that the preliminary design was greatly improved with the mathematical and numerical modeling.

Ex.Stage IV. Implementation of the Test: Injection and Monitoring the Online Measurement System.

After the test has been designed, its implementation is attached to the relevant part of the tracer test design. The final design of the previous stage is the basis for the execution of the test. It is necessary to try to comply as closely as possible the provisions of the design. In this case practically all of the test implementation was attached to the design, both the injection and the measurement of the tracer with SML, was practically 100% fulfilled.

Furthermore, required activities were carried out, such as: revision of mechanical condition of the wells, calculation of capacity of the pipe and displacement volume of injection fluid, sampling prior to tracer injection, injection of the tracer, monitoring radioactivity in the system and necessary adjustments in the measurement window.

Online Measurement System, SML, measures real-time radioactive activity, simultaneously prints the result, also shows it on the screen and stores it in the memory. Specialist can perform real-time analysis of tracer activity passing through the SML. This is an invaluable advantage since you can make instant decisions: there is no need to wait for lab results of radiochemical analysis of samples. In this industrial application radioactive tracer used was Cobalt 57. After a certain period previously established in the final design, which was measured as tracer activity that is going through the measurement system, it is possible to pass the recorded data via a laptop.

Ex.Stage V. Analysis of the Results Provided by the Online Measurement System.

At this stage, results are verified, seeking congruency per well. They are analyzed with respect to the field log and a priori analysis of data provided by SML. In addition to the amendments that could be made during the process. After these are validated, it is proceed to determine the concentration, based on the flow rates of producing wells. The tracer breakthrough curves obtained are analyzed per well. Curves are obtained of recovery activity of tracer per well and curves resulting from solving the inverse problem for tracer flow. A response of cumulative tracer per field is performed. Matter balance is checked with this cumulative curve, which should lead to cumulative tracer mass is less than or equal to the injected tracer mass.

As an example of using this method it is presented the case of well A. The distance from the injection well to the production well is 2135 m.

Ex.Phase V.1.

Figure 13:
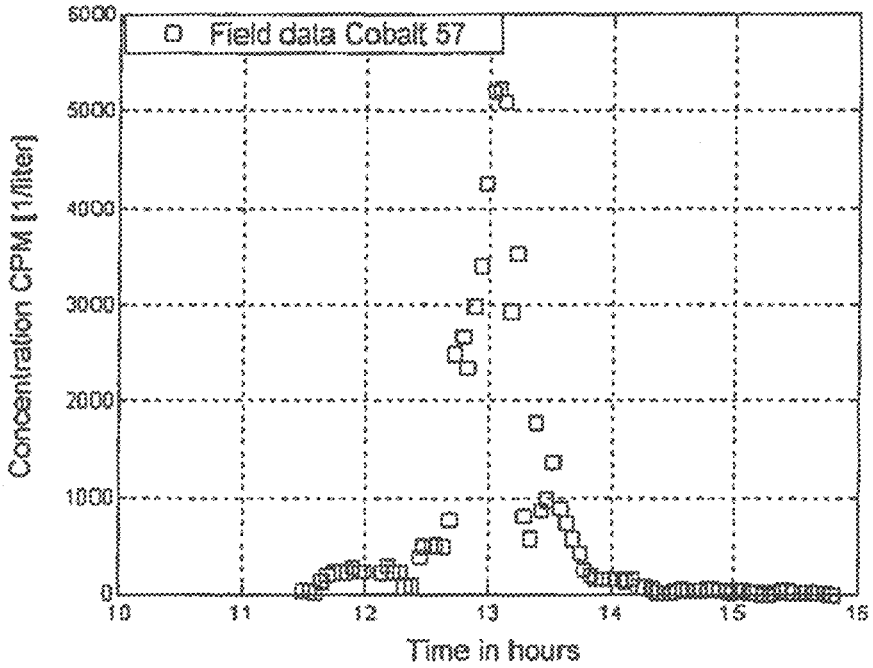
FIG. 13 shows the data measured by the online measurement system (SMD, Sistema de Medición en Linea) connected to well A of one of the reservoirs in the Zona Marina (Mexico).

Curves are analyzed from the SML. FIG. 13 presents the data obtained with the SML. Likewise, it can be can seen the great amount of data obtained from the SML, in a period less than 5 hours, 85 measures are taken of tracer concentration, which is a remarkable improvement in the tracer tests, since it had never gotten this much data before in such a short time. It has its own importance because you can physically see the tracer pulse going through the production line in real time, and it is certain that they are measuring the tracer concentration precisely in the most important period of the test. This has a great impact on the estimation of physical parameters by solving the inverse problem, because as field data have more and better quality you may have a better approximation to the actual parameters of the reservoir parameters.

The procedure for calculating the activity of tracer recovered is as follows: After making a filtering, depending on the test conditions and considering the background radiation, recovered activity of tracer per well is calculated with the following integral $$R(t)=\int_0^t Q(t)C(\tau)d\tau$$

Figure 14:
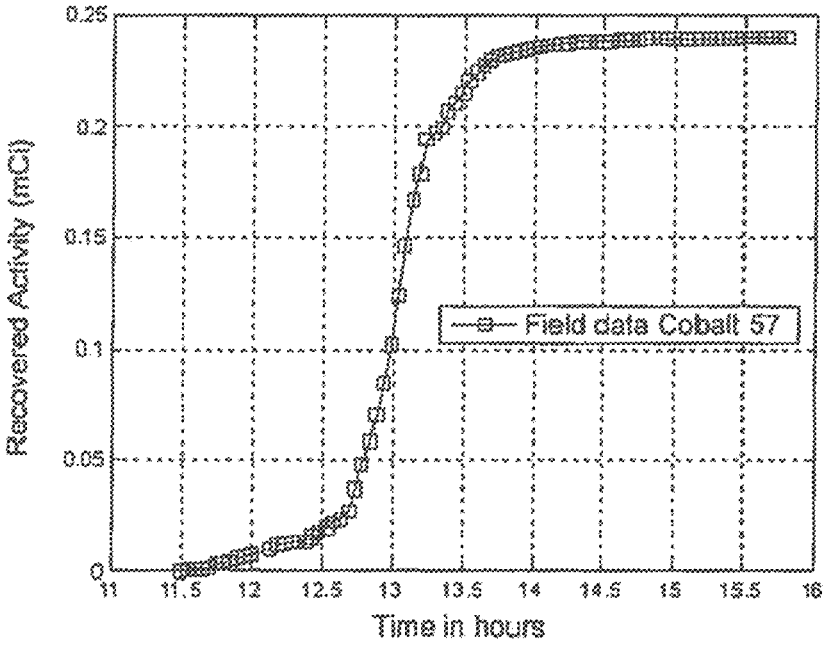
FIG. 14 shows the recovered activity of tracer in Well A from one of reservoirs in the Zona Marina.

This integral was previously discussed. FIG. 14 shows total activity recovered obtained with field data provided by SML.

With the calculation of the total activity recovered (see FIG. 14) it can be evaluated the amount of tracer produced in each well and therefore the total tracer which remains in the porous medium. In this case, after 6 hours continuously measuring the concentration in the production line, it was noted that it had already reached the background radiation, so it was decided to stop monitoring. It should be noted that the above is not possible with a traditional sampling, and it might take several days, weeks or even months, without knowing the concentration of tracer per well.

Undoubtedly, the use of this method in the analysis of tracer tests is innovative to the extent that the practice of performing such tests will be modified.

Ex. Stage VI. Interpretation of Tracer Test Based on Mathematical Modeling, Numerical Simulation, Optimization of the Flow Parameters and the Overall Behavior of the Field.

Corroboration of Prediction in the Field and Analysis of Samples.

After the Phase VI. 1 and VI. 2 were performed of the method for interpreting tracer tests, which consist of a review of the original objectives of the test and verification of compliance with the design parameters, it is proceeded to carry out the next phase:

Ex. Phase VI.3.

Determination of differences with the mathematical model. For this example it is used the model of J. Ramírez-Sabag et al., (1988). Dimensionless variables and parameters were introduced that are very useful in the optimization of the physical parameters which are:

$$x_D=x/L$$

$$t_D=tu/L$$

$$Pe=uL/D \tag{1}$$

where L is the distance between wells, u is velocity of the fluid transporting the tracer and D the hydrodynamic diffusion coefficient. This model in terms of the dimensionless variables is expresses as:

$$C(x_D, t_D) = \frac{E\ x_D}{\sqrt{4\pi t_D^3/Pe}}\exp\left[-\frac{Pe(x_D - t_D)^2}{4t_D}\right] \tag{2}$$

wherein E is a scaling factor proportional to the total amount of tracer by area unit that arrives to the study well.

Ex. Phase VI.4.

Calculation of recovered activity. For this example, this calculation has been previously conducted within the Ex.Phase V.1., (see FIG. 14)

Ex.Phase VI.5.

Inverse problem. Determination of the parameters involved. This step determines the physical variables obtained through the inverse problem solution (based on the method illustrated in FIG. 8).

This activity is basically the application of nonlinear optimization methods for the determination of the main flow parameters involved in the representative field model. For this case and based on the selected mathematical model, certain parameters of variables were chosen to be determined through the optimization process, $x_D$, Pe and E. Here, the value of $x_D$ provides the total net distance traveled by the tracer on average. The Pe number provides information on which type of process is dominant, for example, if it is advective or dispersive and in each cases it is possible to quantify it. These parameters provide valuable information to the specialist in reservoir characterization because they are obtained from the response of the oil field and based on mathematical models. The parameter E provides information about the amount of tracer per unit area which reached the well.

Moreover, according to equation (1), for transforming the time variable of the dimensionless time test, which was performed in the curve fitting, the average speed u is required.

The average velocity u is calculated using the first moment of the curve with the concentration data obtained with the SML (see FIG. 13). In this case <t>=13.00 hours, and L=2135.0 m it is obtained u=3942 m/day. This value rescales time and then proceeds to optimize the following objective function:

$$OF(x_D, Pe) = \sum_{i=1}^{N} [C(x_D, Pe; t_i) - c_i(t_i)]^2 \tag{3}$$

where the $c_i(t_i)$ are concentration values measured in well A at time $t_i$. The SML provides greater reliability of the optimal parameters found, because traditionally, there were only few data of concentration as a function of time. By contrast, with the SML, there is a lot of them and not only quantity, but quality, since concentration measurements are collected in the time periods in which the tracer response is the most significant, i.e., where the maximum concentrations are present.

It has been used an optimization method that has proven to be one of the most robust (Ramirez-Sabag et al, 2005) for these functions which is the Nelder-Mead. the method properly converged and the values of certain parameters are:

| $x_D$ | P e | E (Bq/l) | Objective Function |
|---|---|---|---|
| 1.0024 | $7.7740 \times 10^3$ | $1.8542 \times 10^2$ | $1.2584 \times 10^6$ |

Figure 15:
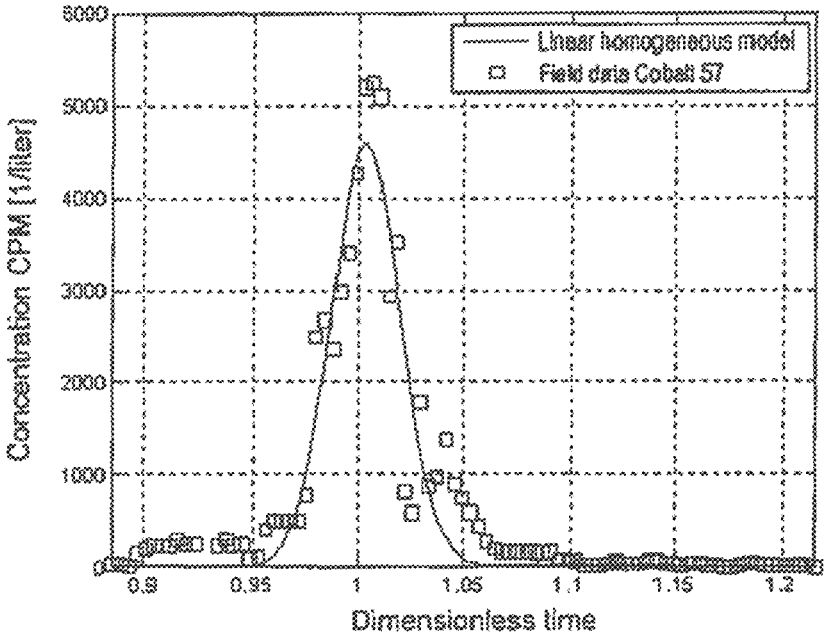
FIG. 15 shows the field data obtained with the SML fitted with the Linear Homogeneous Model.

FIG. 15 presents data adjustment with the linear homogeneous model. From this figure it can be seen that the model fits well with the field data. That is, from a simple model basic behaviors of the fluid within the reservoir can be obtained. Further values will be obtained of the actual physical parameters of the reservoir near the wells where tracer was recovered.

Figure 16:
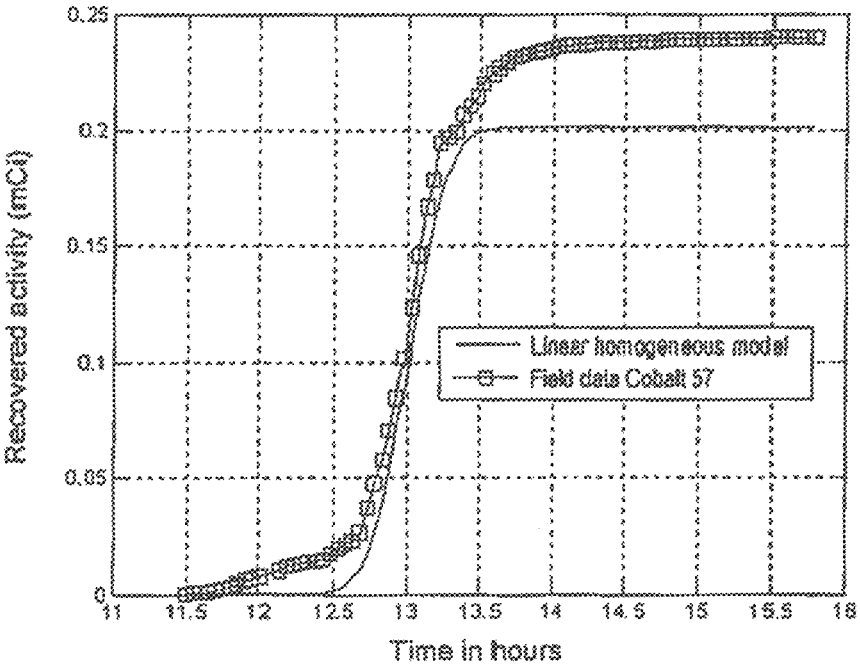
FIG. 16 illustrates the recovered activity of tracer and what the Linear Homogeneous Model predicts.

The corresponding curves of cumulative recovery of tracer can be seen in FIG. 16. The same procedure is performed with the curves of the wells where significant tracer response has been obtained from the field of study, obtaining, as expected, different parameters for each area involved.

From the definitions in Eq. (1) it follows that total net distance traveled is given by $X_D$ as $$x = x_D L, \tag{7a}$$

dispersivity, α, defined through D=αu, is obtained from Peclet number in the following way:

$$\alpha = L/Pe, \tag{7b}$$

and the hydrodynamic dispersion coefficient through $$D = uL/Pe. \tag{7c}$$

Using the results, i.e., $X_D$=1.0024 Pe=$7.7740\times10^3$ together with L=2135.0 m, which is the distance from the injector well to producer well, it is obtained the following physical values:

$$x = 2140.1 \text{ m}$$

$$\alpha = 0.2746 \text{ m}$$

$$D = 0.0125 \text{ m}^2/\text{s} \tag{8}$$

Note that the net total distance traveled by the tracer is slightly greater than the distance between wells and surface dispersivity that corresponds to a purely advective process.

Ex. Phase VI.8.

Dispersion coefficient in terms of permeability. High speeds reported by tracer test at the well in study and in some other of the field may be due to the existence of channels that communicate the injection well and have not been considered in the original model of the field. For this example it was not necessary to determine the dispersion coefficient in terms of the permeability, because it is obtained the hydrodynamic dispersion coefficient and the speed based on the first point of the curve of each well.

Main Advantages of the Integral Analysis Method of the Inter-Well Tracer Tests.

The application of the invention herein presented, both for the design, implementation, and for the interpretation of the inter-well tracer tests, has the following advantages:

a) The integral analysis of all components of this type of testing is an important contribution, since the interaction between each of the lines of work produces: i) lower the probability of error and more importantly, ii) a commitment to make all these lines, from design to interpretation, in plain terms, leads to a test with good results.

b) The fact to consider predictions for tracer arrivals, analytical models representing the tracer flow in porous media, simplistic models and rapid implementation, which requires very little information, provides a good approximation of the arrival times, amounts of tracer injected, forcing us to design a measurement of tracer, which prevents rapid arrivals. Additionally, and very important, is that these predictions allow for tracer response curves continuously that are invaluable for purposes of determining the optimal physical parameters of the reservoir.

c) The Online Measurement System, OMS. and its connection to the well production line (FIGS. 4 and 5) is to revolutionize the way how to do tracer tests, as analysts of these tests have the opportunity to know concentration values in real time and therefore to adjust them accordingly to the measurement of the activity of the tracer at the precise time it is required. Save onerous costs, both in itself and sampling laboratory analysis. In addition to the foregoing, provides a concentration curve substantially continuously, since the measurement can be set up every minute, if desired. Therefore, it is possible to have large amount of data, which previously had no way to get them, because the samples are sporadic, when very often twice a day in each well usually.

d) Measurement of the concentration of tracer made with SML minimizes the possibility of human error because most of the data acquisition process is automated.

e) Perform test predictions with the numerical simulation of the field, a great advantage in the design, as can be seen here monitoring wells not involved in the preliminary design, injection rates, and tracer mass injected, so that tracer concentrations produced in the wells can be detected.

f) It is checked if the amount of tracer to be injected in sufficient and necessary to ensure its detection in the producing wells. In general, this is a critical point, because if it is not injected enough or less than detectable amount of tracer to label the necessary fluid volume, it will lead to an erroneous conclusion about the behavior of the fluids. Also, excessive amounts of tracer represent not only unnecessary costs, but also may cause problems of separation of tracer from produced fluids, also implies unnecessary environmental burden, which could be dangerous depending on the characteristics of the tracer used.

g) It is extended monitoring to wells not considered observation wells in the preliminary design, but based on predictions of the numerical simulation, they would be where tracer is produced. Ignoring them would lead to incomplete field test results, assuming, of course, that in effect simulation predictions were correct. On the other hand, if predictions were not correct, these data together with the test could improve the numerical model, at least in the area of study.

h) The numerical processing of data obtained with SML can be performed almost simultaneously while still making more tracer concentration measurements in wells.

i) After numerical processing, it follows to solve the inverse problem thus obtaining physical parameters of the rock-fluid system almost while measurements are made; it is as if you were taking a picture of the physical properties of the reservoir in real time.

j) It establishes a better sampling program per well than traditional design program because this procedure is based on tracer response curves, obtained from both mathematical modeling and numerical simulation. While sampling program of traditional design is based on experience.

k) The simple comparison of the results of the field test with the predictions of the simulator requires corroborating validation of numerical model or otherwise trying to improve it through adjustment of the tracer response curves. This is essentially a method for improving the numerical model of the field through tracer tests.

l) No doubt, considering the global behavior of the field, with all information from various sources such as static characterization (geophysical well logs, seismic, structural geology, petrophysics, etc.) as well as the dynamic characterization (pressure tests, tracer tests, movement tests, PVT analysis and core analysis), involves providing results consistent with all the phenomena involved in these processes, which means a greater approximation of what happens in the field.

In addition to the above advantages, this invention has an added value, this value consists in that data from a field test, based on a sustained design, will be more reliable and contain more elements to perform a better interpretation of the same evidence, because they already have the predictions obtained with mathematical modeling, and only have to adjust the two curves (the field data and model). Also, you have the opportunity to confirm the numerical simulation or where appropriate, refine the numerical model used.

From the above it can be argued that this invention for Integral analysis method of inter-well tracer tests is a sustained and robust method which allows the specialist to have better elements to perform the same. And consequently, this method will facilitate the procurement of field data that more faithfully represent tracer flow through porous media.

Using this method can lead to an interpretation of the tracer tests not only for short times (related to the duration of the test), but also for long times. On economic issues, it is not common follow the tracer tests at large times, through the procedure presented here it is possible to extrapolate the test results and consider them in making decisions.

It is also shown that an interpretation of tracer tests based on the proposed procedure allows us to evaluate comprehensively the behavior of injection fluids into a reservoir for recovery of hydrocarbons. The procedure, referred to as a whole, contains elements from the analysis of the feasibility of conducting the test, the design, operating with the corresponding devices (online measurement system), mathematical interpretation, based on the corresponding model adjustments, algorithms needed to obtain physical parameters and the final interpretation of tracer test comprehensively.

Conclusions of the Integral Analysis Method of Inter-Well Tracer Tests.

It has presented a method constituted by each of the elements necessary for the Integral analysis method of inter-well tracer tests. It has been shown that the main problems in obtaining quantitative information from tracer tests is completely relate with the inadequate test design, insufficient sampling and further that there are few techniques developed for the interpretation of these tests. The use of online measuring system, (FIGS. 4 and 5) is a substantive element of this invention, since it allows to obtain tracer response curves far more reliable (both statistically and more approximated to the actual transportation of the fluids in the reservoir) which impacts greatly on the quantitative determination of flow parameters involved in mathematical models. Also, with this method of analysis, the field numerical model can be improved to obtain reliable data (via the online measurement system and a test designed with technical background) and the adjustment of the predictions of the simulator with the results of testing. Additionally, with the use of this method it is had the great advantage of sensitivity of results, i.e., they are obtained in real time. Besides the above, the reduction in costs is truly remarkable since no sampling is done, nor laboratory analysis thereof, so that the cost of specialized staff time taking samples, carrying cylinder samples and their respective radiochemical analysis are not considered in the budget. Significantly, these concepts are more expensive than this type of testing from design, monitoring respective technical elements, mathematical modeling, numerical simulation, to the analysis and interpretation of results.

The specialist who applies "Integral analysis method of inter-well tracer test" will get tracer test that can be interpreted quantitatively, thereby substantive information for decision making managers in their enhanced oil recovery.

It has been shown that the feedback between the numerical simulation, the field data and mathematical modeling completes the information that can be obtained from a tracer test.

With this method not only can be determined the communication between different parts of the field, and calculate average of some physical properties but also improve the numerical model of the field, at least in the study area.

Given the above, it can be concluded that the use of this method is very useful in the analysis of inter-well tracer test, from the very design of the test, its operation until a comprehensive interpretation.

The invention claimed is:

1. A method for the Integral analysis of inter-well tracer tests in an oil reservoir to measure injection fluid flow behavior and determine physical characteristics in a reservoir between an injection well and an output well, and determine flow parameters of an injection fluid in a fluid injection process for oil reservoirs to improve secondary oil recovery, the method comprising six stages:

Stage I, defining objectives and preliminary analysis of geological and physical characteristics of the oil reservoir;

Stage II, collecting, classifying and validating data obtained in Stage I;

Stage III, design of the inter-well tracer test from data obtained in Stage II by mathematical modeling of tracer flow in a porous media;

Stage IV, implementation of the inter-well test from Stage III by injecting a tracer in the injection fluid into the injection well and obtaining tracer test data corresponding to the concentration and amount of the tracer measured for a predetermined period of time at the output well spaced from the injection well by an online measurement system SML in a wellhead;

Stage V analyzing the tracer test data obtained by the online measurement system to determine at least one physical characteristic of the oil well from the measured concentration of the tracer at the output well relative to the amount of tracer added to the injection well, and, Stage VI, determining flow patterns and injection fluid behavior in said reservoir from the tracer test data by mathematical modeling and numerical simulation.

2. A method for the Integral analysis of inter-well tracer tests according to claim 1, wherein Stage I further defines the objectives of tracer test and perform preliminary analysis of the field by the regional context of the reservoir, performing a geological and geophysical and fluid dynamics study, and an analysis of exploitation conditions.

3. A method for the Integral analysis of inter-well tracer tests according to claim 1, further comprising providing a database containing the localization plan of the field, the geological model of the reservoir, production data, mechanical condition of the well, reports of PVT analysis in addition to the numerical simulation model.

4. Integral analysis of inter-well tracer tests according to claim 1, wherein Stage III determines a design of the tracer test sustained on relevant technical elements of phenomenology within the reservoir, mass transport, fluid movements, pressure changes, fluid physicochemical behavior, geological structure, petrophysics, injection and production rhythms of all wells in the field under study.

5. A method for the Integral analysis of inter-well tracer tests according to claim 4, further comprising mathematical models describing tracer transport within the reservoir and the use of numerical simulation.

6. A method for the Integral analysis of tracer inter-well tests according to claim 1, wherein the steps in Stage IV are: revision of mechanical condition of the wells, calculation of pipe capacities and fluid displacement volume, sampling before tracer injection, tracer injection and finally monitoring of radioactive activity passing through the online measurement system.

7. A method for the Integral analysis of inter-well tracer tests according to claim 1, further comprising in Stage V calculating the amount of tracer arriving to the wellhead by eliminating background radiation, and performing an inversion process of tracer concentration data.

8. A method for the Integral analysis of inter-well tracer tests according to claim 7, further comprising measuring the average velocities of the tracer, hydraulic dispersivity, actual distance traveled by the tracer, dispersion coefficient, fracture width, matrix porosity, fracture porosity of the deposit field by an inversion process of tracer response and from predictions of the model used of data inversion process of a tracer measured in the online measurement system at the wellhead and from mathematical modeling.

9. A method for the Integral analysis of inter-well tracer tests according to claim 1, wherein Stage VI determines flow preferential directions according to irruptions of tracer in the field wells, swept volumes, and balance of tracer matter and duration of the test.

10. A method for the Integral analysis of inter-well tracer tests according to claim 1, further comprising estimating recovered tracer per zone from the reservoir.

11. A method for the Integral analysis of inter-well tracer tests according to claim 1, further comprising determining preferential flow directions according to irruptions of tracer in the field wells, swept volumes, and balance of tracer matter and duration of the test.

12. A method for the Integral analysis of inter-well tracer tests according to claim 1, wherein direct results are obtained from the field and not necessarily match numerical simulation, preferential flow directions, tracer arrivals, balance of matter on long times, according to the scheme of exploitation of the field, permeability, "impermeable" barriers which are not and which are irrefutable elements allowing a better characterization of the reservoir.

13. A method for the Integral analysis of inter-well tracer tests according to claim 1, characterized in that the sequence: a) mathematical modeling, where tracer response curves are built, total tracer produced curves are determined with analytical and numerical predictions and they are compared with the curves obtained in the field; b) solution of the inverse problem, wherein parameters of the rock-fluid system are determined, which influence on tracer flow behavior through porous media, such as fracture width, porosity, longitudinal dispersivity coefficient, matrix diffusion coefficient and size of the block whose range value are as follows:

| Parameter | Range |
|---|---|
| Fracture width | $0.0001 \leq w, m \leq 0.01$ |
| Block size | $2.05 \leq d, m \leq 25.0$ |
| Matrix porosity | $0.01 \leq \Phi_2$, fraction $\leq 0.35$ |
| Longitudinal dispersivity | $0.1 \leq \alpha, m \leq 400$ |
| Matrix diffusion coefficient | $1E-12 \leq D_e, m^2/d \leq 1.38E-5$. |

14. A method for the Integral analysis of inter-well tracer tests according to claim 1, wherein comparison results, gotten from solving the inverse problem with those gotten by numerical simulation, are analyzed and, if there were the case, numerical model is adjusted (at least in the test area), permeability equivalent is determined and matter balance is performed.

15. A method for the Integral analysis of inter-well tracer tests according to claim 1, wherein the results are integrated for interpretation.

16. A method for the Integral analysis of inter-well tracer tests according to claim 1, wherein mathematical modeling rock-fluid system parameters are obtained, as "actual" average velocities calculating the first moment and the distance between the producer well and the injector well.

17. A method for the Integral analysis of inter-well tracer tests according to claim 1, wherein results of tracer test are integrated to the overall behavior of the field providing a single image of the reservoir.

18. A method for the Integral analysis of inter-well tracer tests according to claim 1, wherein zones are predicted with isoproperties in the field of study with adjustment of tracer curves, such as porosity and permeability, where porosity is within the range of 0.01 and 0.35; and permeability is within $0.1 \leq k$, $md \leq 10000$.

19. A method for the Integral analysis of tracer inter-well tests according to claim 1, wherein communication between wells is quantitatively determined through cumulative concentration curves per well.

20. An Integral analysis method of inter-well tracer tests according to claim 19, further comprising determining associated flow rates derived from the injection.

21. A method for the Integral analysis of tracer inter-well tests according to claim 1, further comprising an interpretation of tracer tests for short and long times.

22. A method for the Integral analysis of inter-well tracer tests according to claim 1, wherein the online measurement system (SML) of radioactive tracers on headwells, comprises:

(I) a power plant for continuous energy supply, which consists of a solar B panel, a battery bank, a controller and a DC/AC inverter (II) a gamma radiation detection module, characterized in that a liquid crystal scintillation detector is housed in a high pressure stainless steel container, through which a sample of fluids from the reservoir continuously flow, being the concentration of B this sample to be quantified (III) a programmable data acquisition module through which all operation, control and handling functions of information are performed so that the system operates autonomously, according to the requirements of each test, comprising the following stages: a) signal comparison and conditioning, b) count pulses, c) control and storage, and d) user B interface data input/output (IV) a laptop that has specialized tools and with the computer program developed specially for communication with the acquirer, to perform the following functions: a) programming of all functions of acquisition, control and storage data of acquirer, b) reading or collecting concentration vs. time data stored in memory up to three channels, c) processing, presentation and management of information.

23. A method for the Integral analysis method of inter-well tracer tests according to claim 1, wherein the solution of the Inverse problem is used to interpret the behavior of tracers measured wherein:

i) input values are tracer concentration values measured with the online measuring system at different times and recording the time vs. tracer concentration;

ii) defining the objective function in the least squares sense constructed as the sum of the squared differences between a mathematical model prediction $C(\alpha; t_k)$ $C(\alpha; t_k)$ and measured data of concentration $C_k$ for each time point $t_k$;

iii) minimizing the objective function by a nonlinear optimization method; and iv) obtaining an optimum value of physical parameter of a reservoir.

24. The method claim 1, wherein said method determines an injection fluid flow and properties of rock formations in the well system, a well system having an injection well and an outlet well, the method further comprising the steps of supplying the tracer to the injection well, measuring the real time concentration of the tracer over a predetermined period of time from the output well by an online measurement system at a wellhead and calculating a tracer flow rate corresponding to a tracer flow in porous media.

25. The method of claim 1, further comprising introducing the injection fluid to the injection well in response to the measured concentration of tracer at the output well and the injection fluid behavior in the reservoir to enhance secondary oil recover from the well.

26. A method for the integral analysis of inter-well tracer tests in an oil well of an oil reservoir, by implementation of an analysis and interpretation of tracer test results obtained from the tracer tests by an Online Measurement System results (SML) at onshore well facilities, wherein said method comprises:

a) connecting the Online Measuring System to a well production line;

b) programming an operation window;

c) feeding part of an injection fluid in a well line from an output well of the reservoir to the online measuring system;

d) continuously measuring of the tracer concentration in the injection fluid flowing through the Online Measuring System;

e) reincorporating of the injection fluid from the online measuring system to the well line;

f) plotting data of the tracer concentration obtained from the Online Measuring System and quantification of background radiation;

g) calculating the amount of tracer recovered from the output well and the amount of tracer remaining in the well by the integral once the data filtering has been carried out:

$$R(t)=\int_0^t Q(\tau)C(\tau)d\tau,$$

where Q(t) is the volume flow rate passing through a downpipe and C(t) is the tracer concentration measured by the Online Measuring System;

h) interrupting the measuring when the concentration of the tracer measured by the Online Measuring System is the same as background radiation.

* * * * *